US005482475A

United States Patent [19]

Kawaguchi

[11] Patent Number: 5,482,475

[45] Date of Patent: Jan. 9, 1996

[54] COAXIAL CABLE CONNECTOR

[75] Inventor: Akira Kawaguchi, Musashimurayama, Japan

[73] Assignee: The Whitaker Corporation, Wilmington, Del.

[21] Appl. No.: 456,004

[22] Filed: May 31, 1995

Related U.S. Application Data

[63] Continuation of Ser. No. 239,146, May 6, 1994, abandoned.

[30] Foreign Application Priority Data

Jul. 14, 1993 [JP] Japan ..... 5-043475 U

[51] Int. Cl.[6] ..... H01R 4/24

[52] U.S. Cl. ..... 439/394; 439/582

[58] Field of Search ..... 439/394, 582, 439/813, 63, 596, 467, 468, 689, 690, 695, 400

[56] References Cited

U.S. PATENT DOCUMENTS 4,708,414 11/1987 Lam ..... 439/394 OR
5,062,804 11/1991 Jamet et al. ..... 439/394 OR
5,083,934 1/1992 Kawaguchi ..... 439/394 OR
5,154,632 10/1992 Ijiri ..... 439/394 OR
5,314,349 5/1994 Czeschka et al. ..... 439/394 OR

*Primary Examiner*—Neil Abrams
*Assistant Examiner*—Daniel Wittels
*Attorney, Agent, or Firm*—Adrian J. LaRue; Timothy J. Aberle

[57] ABSTRACT

A prepared end of a coaxial cable (30) is inserted in an insulating housing (11), which can be fixed to a circuit board, having a signal contact (12) and a ground contact (13) arranged in such a manner that a core conductor (31) and an outer conductor (32) of the coaxial cable (30) come against, respectively, the signal contact (12) and the ground contact (13). In this position, a cover (20) is joined to the insulating housing (11) by a hinge (21) and then is closed and secured by a mounting screw (25). The mounting screw (25) is located on one side of the coaxial cable (30) and the other side of the cover (20) is secured by latch lock (18, 28).

20 Claims, 2 Drawing Sheets

COAXIAL CABLE CONNECTOR

This application is a continuation of application Ser. No. 08/239,146 filed May 6, 1994, now abandoned.

This invention relates to electrical connectors, specifically to connectors for coaxial cables suited for selectively connecting coaxial cables to circuit boards.

BACKGROUND OF THE INVENTION

Coaxial cables having uniform characteristic impedance along their entire length (for example, 50 Ohm) are widely used for efficient and distortion-free transmission of high-frequency signals ranging from MHz to GHz bands. Depending on desired characteristic impedance and other parameters of the coaxial cables, they are made in various dimensions and designs. Generally, a coaxial cable consists of a center conductor made of a copper or a copper alloy solid wire, surrounded by polyethylene or other plastic dielectric, a braided outer conductor made of tinned copper wire, and an insulating protective layer or jacket. The outer conductor of some coaxial cables is made in the form of a tubing without external jacket.

Coaxial cables are usually used in data networks for transmission and reception of data signals of relatively high frequencies. In many cases, it is necessary to use a coaxial connector for linking together such coaxial cables and circuit boards processing such signals. This is due to the fact that soldering a coaxial cable directly to a circuit board results in a poor maintenance serviceability.

Examples of conventional connectors for joining coaxial cables to circuit boards can be found in Patent Disclosures JP (1990)-223169 and JP (1991) 3-1460 made by the inventor of this utility model. In the first example, a pressure-type signal contact and a semi-cylindrical ground contact for the outer or grounding conductor are arranged inside the housing. A prepared and stripped coaxial cable is connected to these signal and ground contacts and clamped by the hinged cover. As the result, the signal conductor and the ground conductor of the coaxial cable become connected respectively to the signal contact and the ground contact. The connector according to the second example, has basically the same design as the first example; that is, it has a pressure-type signal connector and a semi-cylindrical ground contact to which the prepared end of the coaxial cable is clamped by means of the hinged cover.

Disadvantages of the connectors according to the examples described above are that they are of relatively complicated design, are expensive, and do not satisfy the requirements of miniaturization and high-density assembly. In addition, the process of connection of a coaxial cable to the connector is almost as complicated as soldering.

The purpose of this invention consists in offering a coaxial cable connector which is small enough for high-density assembly and provides simple and reliable connection.

SUMMARY OF THE INVENTION

In order to achieve the goals stated above, the coaxial cable connector according to this invention consists of an insulating housing containing a signal contact and a ground contact, and a hinged cover which is made as an integral part of the housing during a molding process. An end of the coaxial cable is prepared by exposing the core or signal conductor and the outer or braided conductor. Then, the prepared end of the coaxial cable is placed in the connector so that the core conductor and the outer conductor are in contact respectively with the signal contact and the ground contact, and clamped by the cover equipped with a screw, thus making an electrical connection.

It is preferable that these connectors for coaxial cable are fixed to the circuit board densely in a parallel array. Coaxial cables with prepared ends are joined in order to each of them by tightening the connector covers. If necessary, coaxial cables can be replaced or switched.

Below, we will give explanations, with reference to drawings, concerning embodiments of the coaxial cable connector according to this invention.

DETAILED DESCRIPTION OF THE INVENTION

Figure 1:
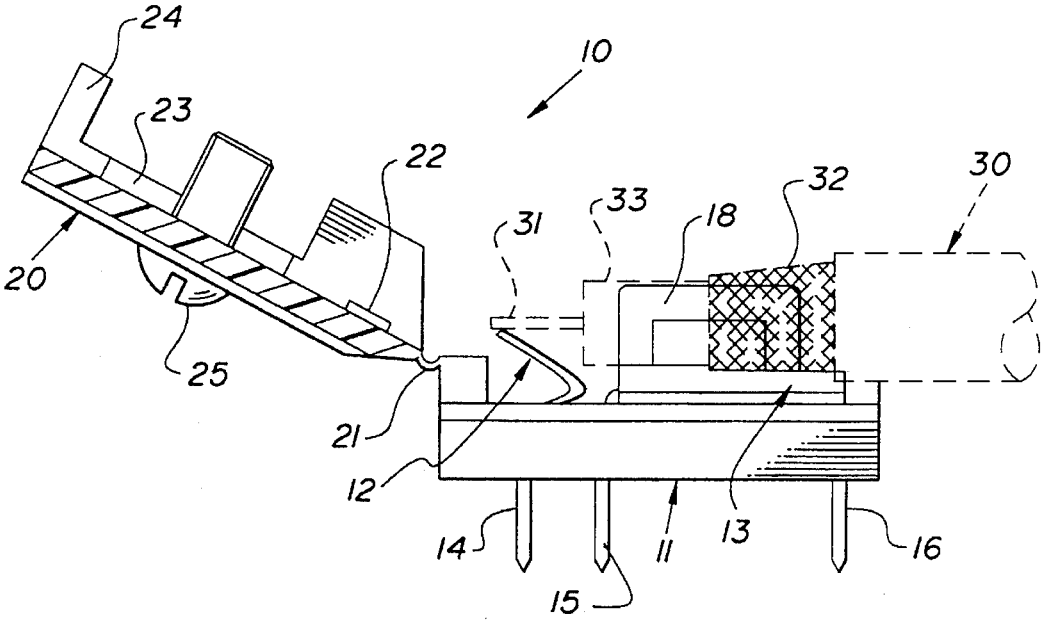
FIG. 1 is a side view of the preferred embodiment of the coaxial cable connector according to this invention before assembly.

The following explanations will be given with reference to FIGS. 1 and 2. The coaxial cable connector 10 according to this invention has an insulating housing (body) 11, cover 20 and off-center mounting screw 25. In the insulating housing 11 there are an elastic signal contact 12 bent in a roughly L shape and a ground contact 13 made in the shape of a tub. The signal contact 12 extends from the bottom of the insulating housing 11, and has a connecting section 14 for attaching the connector to the circuit board (not shown in the drawing) by soldering it in a through hole. The ground contact 13 has connecting sections 15 and 16 extending from both ends of the contact through the bottom of the insulating housing 11 for soldering to the circuit board.

Figure 2:
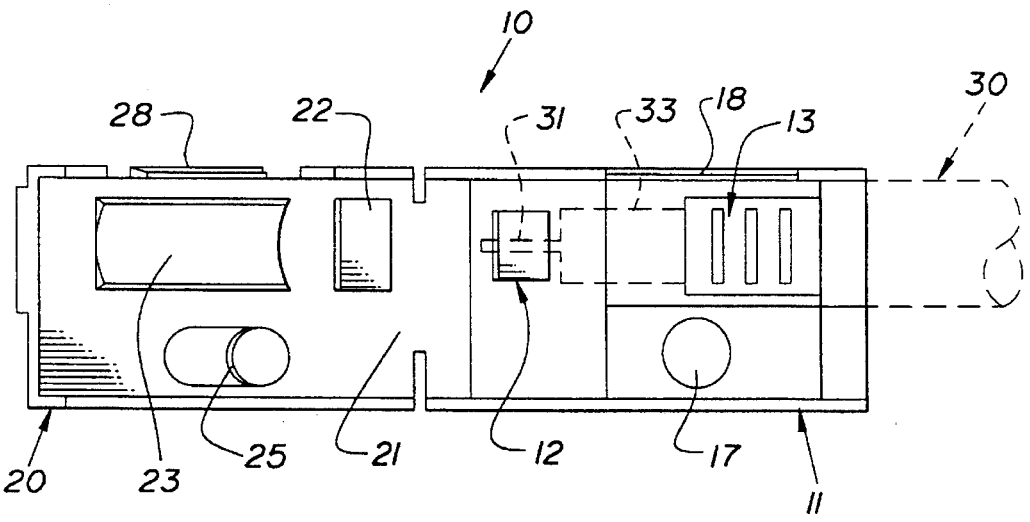
FIG. 2 is a top view of the coaxial cable connector shown in FIG. 1.

As one can see from FIG. 2, the signal contact 12 and the ground contact 13 are arranged off the center-line of the insulating housing 11 (in the drawing, to the upper part). In the other half (the lower part) of the housing a screw opening 17 is made. At the side opposite to the screw opening 17, a latch 18 is formed which can be shaped, for example, as an arch. It is desirable to provide in the ground contact 13 three ribs running across the coaxial cable 30 which overlap the coaxial cable 30 as shown in FIG. 2.

As shown in FIGS. 1 and 2, the coaxial cable 30 is placed in such a position that exposed portions of the core conductor 31 and the outer conductor 32 come against, respectively, the signal contact 12 and the ground contact 13 of the coaxial cable connector 10. When the coaxial cable is in this position the cover 20 is rotated in its hinge 21 to clamp on the prepared end of the coaxial cable 30. Next, the mounting screw 25 is screwed by means of a screw driver into a threaded hole 17 made in the insulating housing 11. As the result, pressing lugs 22, 23 made on the inner surface of the cover 20 exert pressure upon the top of exposed portions of the core conductor 31 and the outer conductor 32, respectively, of the coaxial cable 30. At the same time, the arch-shaped latch 18 made at the side of the insulating housing 11 opposite to the threaded hole 17 becomes engaged with the key 28 formed in the cover 20.

Because of the design of the coaxial cable connector 10 comprising the hinged cover 20 secured by the off-center screw 25 and the latch 28 at the side opposite to the screw, a reliable connection of the cover 20, insulating housing 11, and the coaxial cable 30 can be achieved just by tightening the screw 25. In other words, two sided clamping of the coaxial cable 30 is produced not by using a pair of opposedly located screws, but only one mounting screw 25, thus making it possible to reduce the size of the coaxial cable connector 10. In addition, if necessary, it is possible to make a U-shaped extension at the front end of the cover 20 which, upon closing the cover 20 into the insulating housing 11 will clamp the jacket of the coaxial cable 30, thus providing stress relief for the cable connection.

Figure 3:
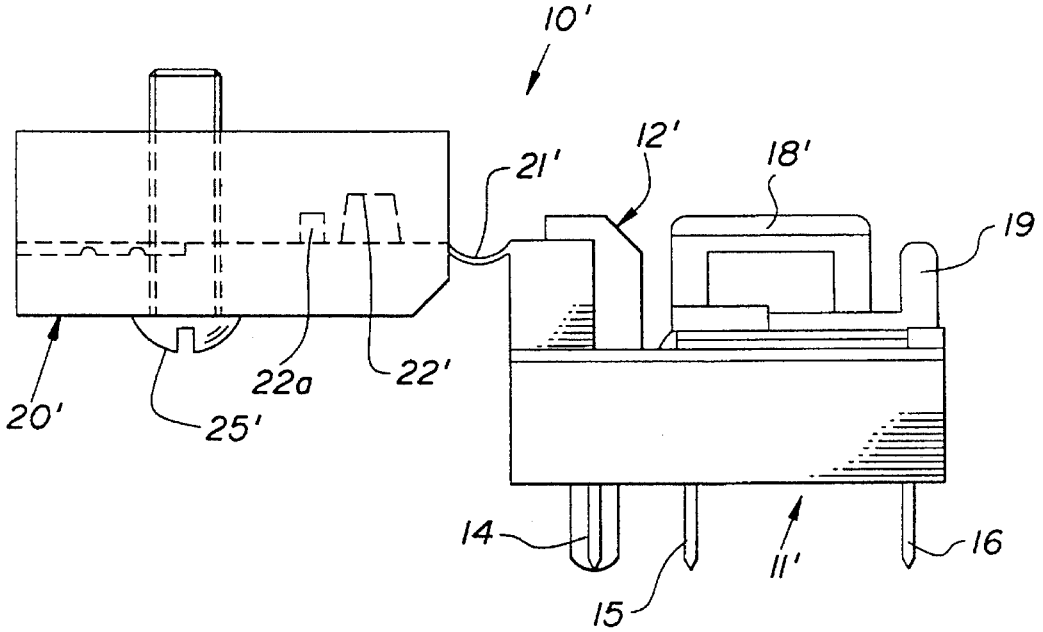
FIG. 3 is a side view of another embodiment of the coaxial cable connector according to this invention before assembly.
Figure 4:
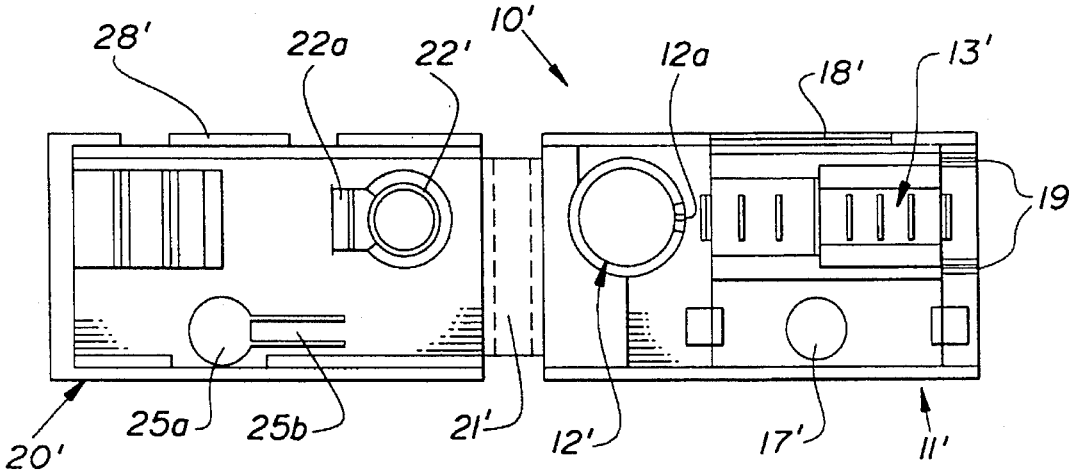
FIG. 4 is a top view of the coaxial cable connector shown in FIG. 3.

FIGS. 3 and 4 represent another embodiment of the coaxial cable connector 10' according to this invention. This embodiment is similar to the embodiment of the coaxial cable connector 10 depicted in FIGS. 1 and 2, and similar items will bear the same numbers, and the explanations given below will concern only distinguishing features.

FIG. 3 represents a side view of the coaxial cable connector 10', and FIG. 4 represents the front (top) view of the same. The main difference of this embodiment from the coaxial cable connector 10' consists in that the contact 12' for the signal conductor 31 of the coaxial cable 30 is made in the form of a cylinder with a slot 12*a*. Cylindrical signal contacts of the same type as the contact 12' are known in the art, but the use of the pressure-type signal contact 12' makes it possible to make connection without exposing the core conductor of the coaxial cable 30 due to the fact that the slot 12*a* cuts through the insulating layer. At side opposite to the hinge 21' of the cover 20' of the insulating housing 11', a pair of retaining arms 19 is provided for the purpose of retention of the coaxial cable 30. Coaxial cable 30, to be terminated or connected with this connector, is prepared (however, there is no need to expose the core conductor) and inserted between these retaining arms 19.

A conical lug 22' is provided on the cover 20', which cover is connected to the insulating housing 11' by means of a hinge 21' near the hinge. When the cover 20' is rotated around the hinge 21', this lug 22' enters the cylindrical signal contact 12' producing a pressure contact between the core conductor 31 of the coaxial cable 30 and the signal contact 12'. An additional lug 22*a* is made next to this conical lug 22' whose purpose is to press the core conductor 31 of the coaxial cable 30 with the insulation into the slot 12*a*. A couple of slits cut in the plastic material of the cover 20' forms a tongue 25*b* stretching into the mounting opening 25*a* for the mounting screw 25'. This tongue 25*b* retains the mounting screw 25' in the opening 25*a* of the cover 20' even when it is loose. This simplifies the operation of insertion of the mounting screw 25' into the opening 25*a* of the cover 20', and reliably retains the mounting screw 25' in the cover 20' even during vibrations and shocks. This makes the operation of joining of the coaxial cable 30 to the axial cable connector 10' easy.

Above, we gave detailed explanations concerning two embodiments of the coaxial cable connector according to this invention. However, it is understood that this invention is not limited only to these embodiments, but also includes various modifications comprising the essential elements of this invention. The major specific features of this invention are the fact that the insulating housing and the cover are connected by a hinge and are molded integrally, and that the signal contact and the ground contact are located off the center line of the connector housing. The cover is secured to the insulating housing in a closed position by a mounting screw on one side and by the latch located at the other side.

As follows from the explanations given above, the coaxial cable connector according to this invention has an elongated (along its axis) shape, thus making it possible to achieve high density of assembly by connecting several coaxial cables to a circuit board without interfering with other connectors. Because of the latch located at one side of the connector, the cover can be secured by only one screw producing connection of the core conductor and the outer conductor of the coaxial cable respectively with the signal contact and the ground contact. The assembly operation is facilitated because the coaxial cable can be temporarily retained by the retaining arms made of the insulating housing. This makes it possible to easily change connection between several coaxial cables.

I claim:

1. An electrical connector having a cover and a housing, said housing includes a ground contact and a signal contact, said electrical connector being characterized in that:

the housing includes an arch-shaped latch member formed on a side of said housing, and the cover includes a key member for registering with said arch-shaped member when the cover is joined to the housing; and said housing and cover each include a respective hole, said holes are adapted to receive a separable fastening means and said cover includes a tongue member for retaining said separable fastening means, the signal contact comprises a hollow insulation displacement member which internally accommodates a complementarily shaped protrusion on said cover for stuffing a jacketed core conductor into an insulation displacement slot when the cover is joined to the housing.

2. The electrical connector of claim 1, wherein the signal contact comprises an acute angle bend for providing flexibility to the end of the signal contact for engaging a core conductor of a coaxial cable.

3. The electrical connector of claim 1, wherein the signal contact is generally hollow and cylindrical, and the protrusion has a generally frusto-conical shape for fitting into the hollow portion of the signal contact.

4. The electrical connector of claim 1, wherein the jacketed core conductor is pushed into an insulation displacement slot by the shaped protrusion and an additional lug formed on the cover.

5. An electrical connector having a cover and a housing, said housing includes a ground contact and a signal contact, said electrical connector comprising:

an arch-shaped latch formed on the housing adapted to engage a latch formed on the cover, and a screw fastener disposed in a hole formed in said cover, said latch and fastener are adapted to secure said cover to said housing, wherein the signal contact comprises a hollow insulation displacement portion, which portion is adapted to internally accommodate a complementarily shaped protrusion formed on said cover for stuffing a jacketed core conductor into the insulation displacement slot when the cover is joined to the housing.

6. The electrical connector of claim 5, wherein the screw fastener is located on a side opposite of the arch-shaped member, for providing a mechanical connection between the housing and the cover when the cover is closed and the latch member and the screw fastener are engaged by the housing.

7. The electrical connector of claim 5, wherein said screw fastener is retained in a hole by a flexible tongue formed on the cover.

8. The electrical connector of claim 5, wherein the signal contact comprises an acute angle bend for providing flexibility to the end of the signal contact for engaging a core conductor of a coaxial cable.

9. The electrical connector of claim 5, wherein the protrusion has a generally frusto-conical shape for fitting into the hollow insulation displacement portion of the signal contact and stuffing said jacketed core therein.

10. The electrical connector of claim 9, wherein the jacketed core conductor is pushed into an insulation displacement slot by the shaped protrusion and an additional lug formed on the cover.

11. An electrical connector having a cover and a housing for connection with a jacketed conductor, said housing includes a ground contact and a signal contact, said electrical connector comprising:

a hollow insulation displacement portion formed on said signal contact, which portion is adapted to internally accommodate a complementarily shaped protrusion formed on said cover for stuffing said jacketed conductor into the insulation displacement portion when the cover is joined to the housing.

12. The electrical connector of claim 11, wherein the protrusion has a generally frusto-conical shape for fitting into the hollow insulation displacement portion of the signal contact and stuffing said jacketed conductor therein.

13. The electrical connector of claim 11, wherein the jacketed conductor is pushed into an insulation displacement portion by the shaped protrusion and an additional lug formed on the cover.

14. An electrical connector having a cover and a housing, the housing including a ground contact, a signal contact and an arch-shaped latch member, and the cover including a key member for registering with the arch-shaped member when the cover is joined to the housing, characterized in that the signal contact comprises a hollow insulation displacement member which internally accommodates a complementarily shaped protrusion on the cover for stuffing a jacketed core conductor into an insulation displacement slot when the cover is joined to the housing.

15. The electrical connector of claim 14, wherein the signal contact is generally hollow and cylindrical, and the protrusion has a generally frusto-conical shape for fitting into the hollow portion of the signal contact.

16. The electrical connector of claim 14, wherein the jacketed core conductor is pushed into an insulation displacement slot by the shaped protrusion and an additional lug formed on the cover.

17. An electrical connector having a cover and a housing, the housing including a ground contact, a signal contact and an arch-shaped latch adapted to engage a latch formed on the cover, characterized in that the cover and the housing have aligned holes into which a screw fastener is inserted, and that the signal contact comprises a hollow insulation displacement portion adopted to internally accommodate a complementarily shaped protrusion formed on the cover for stuffing a jacketed core conductor into the insulation displacement slot when the cover is joined to the housing.

18. The electrical connector of claim 17, wherein the protrusion has a generally frusto-conical shape for fitting into the hollow insulation displacement portion of the signal contact and stuffing the jacketed core therein.

19. The electrical connector of claim 18, wherein the jacketed core conductor is pushed into an insulation displacement slot by the shaped pro,fusion and an additional lug formed on the cover.

20. An electrical connector for electrical connection with a signal conductor and an outer conductor of a coaxial cable, comprising:

a dielectric housing having a ground contact secured therein for electrical connection to the outer conductor of the coaxial cable and a signal contact secured in the housing for electrical connection to the signal conductor of the coaxial cable;

a dielectric cover member hingedly connected to said housing including pressing lugs thereon for pressing the outer conductor and the signal conductor into electrical engagement with the ground contact and the signal contact when the cover member is positioned onto said housing;

latching members along one side of said housing and said cover member for latching said housing and said cover member together along the one side; and said housing and said cover member having aligned holes when the cover member and the housing are in engagement adjacent the other side of said housing and said cover member to accommodate a screw fastener to secure the cover member and the housing in engagement.

* * * * *